US008439017B2

(12) United States Patent
Peters et al.

(10) Patent No.: US 8,439,017 B2
(45) Date of Patent: May 14, 2013

(54) DIAGNOSTIC STRATEGY FOR A FUEL VAPOR CONTROL SYSTEM

(75) Inventors: Mark Peters, Wolverine Lake, MI (US); Eric A. Macke, Ann Arbor, MI (US); Christopher Kragh, Commerce Township, MI (US); Robert Roy Jentz, Westland, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 628 days.

(21) Appl. No.: 12/574,538

(22) Filed: Oct. 6, 2009

(65) Prior Publication Data

US 2011/0079201 A1 Apr. 7, 2011

(51) Int. Cl.
*F02M 33/02* (2006.01)

(52) U.S. Cl.
USPC ..... 123/520; 123/198 D

(58) Field of Classification Search ..... 123/198 D, 123/516, 518–521, 434–435; 73/114.39
See application file for complete search history.

(56) References Cited

U.S. PATENT DOCUMENTS

| | | | | |
|---|---|---|---|---|
| 4,664,134 | A * | 5/1987 | Pera | 137/14 |
| 5,726,354 | A * | 3/1998 | Nomura et al. | 73/114.39 |
| 6,367,457 | B1 * | 4/2002 | Mancini et al. | 123/516 |
| 6,761,154 | B2 * | 7/2004 | Takagi et al. | 123/520 |
| 6,990,963 | B2 * | 1/2006 | Hara et al. | 123/520 |
| 7,059,298 | B2 * | 6/2006 | Ozaki et al. | 123/325 |
| 7,159,580 | B2 | 1/2007 | Shikama et al. | |
| 2002/0112702 | A1 * | 8/2002 | Weldon et al. | 123/520 |
| 2006/0053868 | A1 | 3/2006 | Chung et al. | |
| 2006/0081224 | A1 * | 4/2006 | Spink et al. | 123/519 |
| 2007/0267232 | A1 | 11/2007 | Saito | |
| 2008/0179121 | A1 | 7/2008 | Sauvlet et al. | |
| 2009/0277251 | A1 * | 11/2009 | Takakura | 73/40.7 |

* cited by examiner

*Primary Examiner* — John T. Kwon
*Assistant Examiner* — Johnny Hoang
(74) *Attorney, Agent, or Firm* — Julia Voutyras; Alleman Hall McCoy Russell & Tuttle LLP

(57) ABSTRACT

A method for operating a fuel vapor control system included in a vehicle having an internal combustion engine is provided. The method may include storing positive pressure or negative pressure in an isolated fuel tank, transferring at least a portion of the positive pressure or the negative pressure to an evaporation canister region, and determining degradation of the evaporation canister based on a pressure response of the evaporation canister region while the evaporation canister region is isolated from the fuel tank. In this way, it is possible to utilize pressure that may be passively generated in one portion of the system, even during shut-down engine operation, to verify the integrity of another portion of the system.

18 Claims, 3 Drawing Sheets

DIAGNOSTIC STRATEGY FOR A FUEL VAPOR CONTROL SYSTEM

BACKGROUND AND SUMMARY

Stringent evaporative emission test standards for internal combustion engines have been implemented by various governmental agencies to reduce fuel vapors released from a vehicle's fuel delivery system into the surrounding environment.

Some fuel vapor control systems may include an evaporation canister configured to capture fuel vapors during refueling events in the vehicle. US 2006/0053868 provides a fuel vapor control system configured to spin the vehicle's internal combustion engine to draw down the manifold air pressure (MAP) and create a vacuum within the intake manifold. Fluidic communication between the fuel vapor emission control system and the intake manifold is permitted after the MAP has been drawn down. Then a diagnostic test is performed to determine the fuel vapor control system's integrity once the pressure within the fuel vapor control system has been decreased.

However, the Applicants have recognized several problems with the above fuel vapor control system. For example, spinning the engine to perform a diagnostic test may decrease operating efficiency of the vehicle as well as cause unnecessary wear on various engine components, such as the electric motor used to spin the engine as well as the cylinder valves. Moreover, the diagnostic test described above determines the integrity of the entire fuel vapor control system, preventing separate components from being diagnosed.

As such in one approach, a method for operating a fuel vapor control system included in a vehicle having an engine is provided. The method including storing positive or negative pressure in fuel tank while isolated from an evaporation canister region, transferring at least a portion of the stored pressure to the canister region and indicating degradation of the evaporation canister region based on a response of the transferred pressure in the canister region while the canister region is isolated from the fuel tank.

In this way, it is possible to utilize pressure that may be passively generated in one portion of the system, even during shut-down engine operation, to verify the integrity of another portion of the system. Further, it is possible to verify the integrity of different portions of the system. Thus, it can be possible to more completely test the system, as well as increase the number of evaporation canister testing events. Such a method may be particularly beneficial for use in a plug-in hybrid vehicle due to the fact that the internal combustion engine may not be operated for an extended duration of time. However, it will be appreciated that the aforementioned method may be applied to other types of vehicles utilizing internal combustion engines.

It should be understood that the background and summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
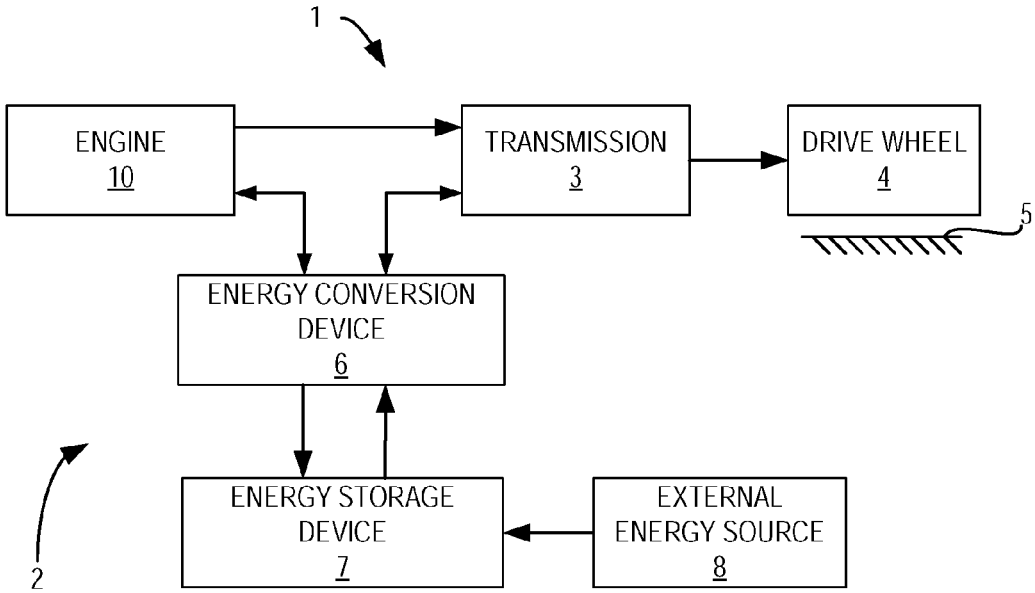
FIG. 1 shows a schematic depiction of a vehicle.
Figure 3:
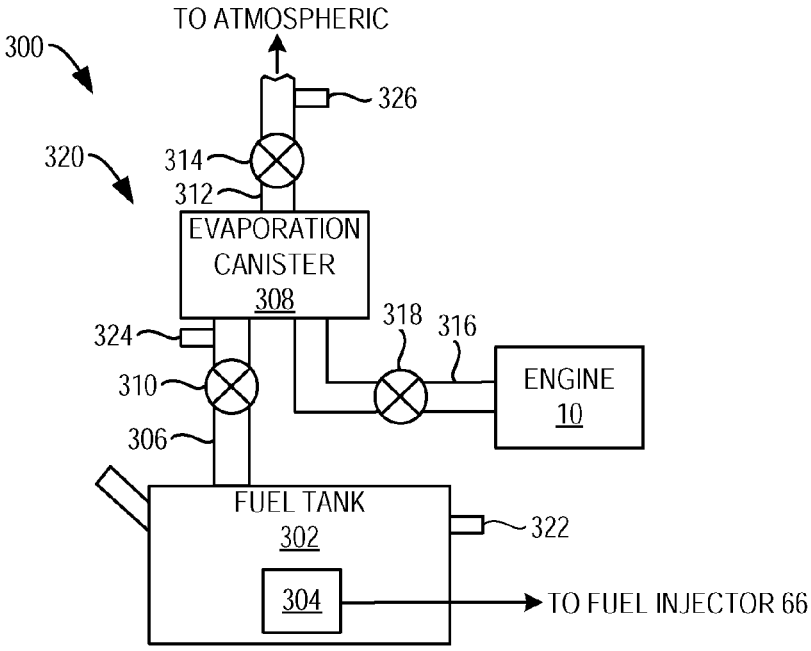
FIG. 3 shows a schematic depiction of a fuel vapor control system which may be included in the vehicle illustrated in FIG. 1.
Figure 2:
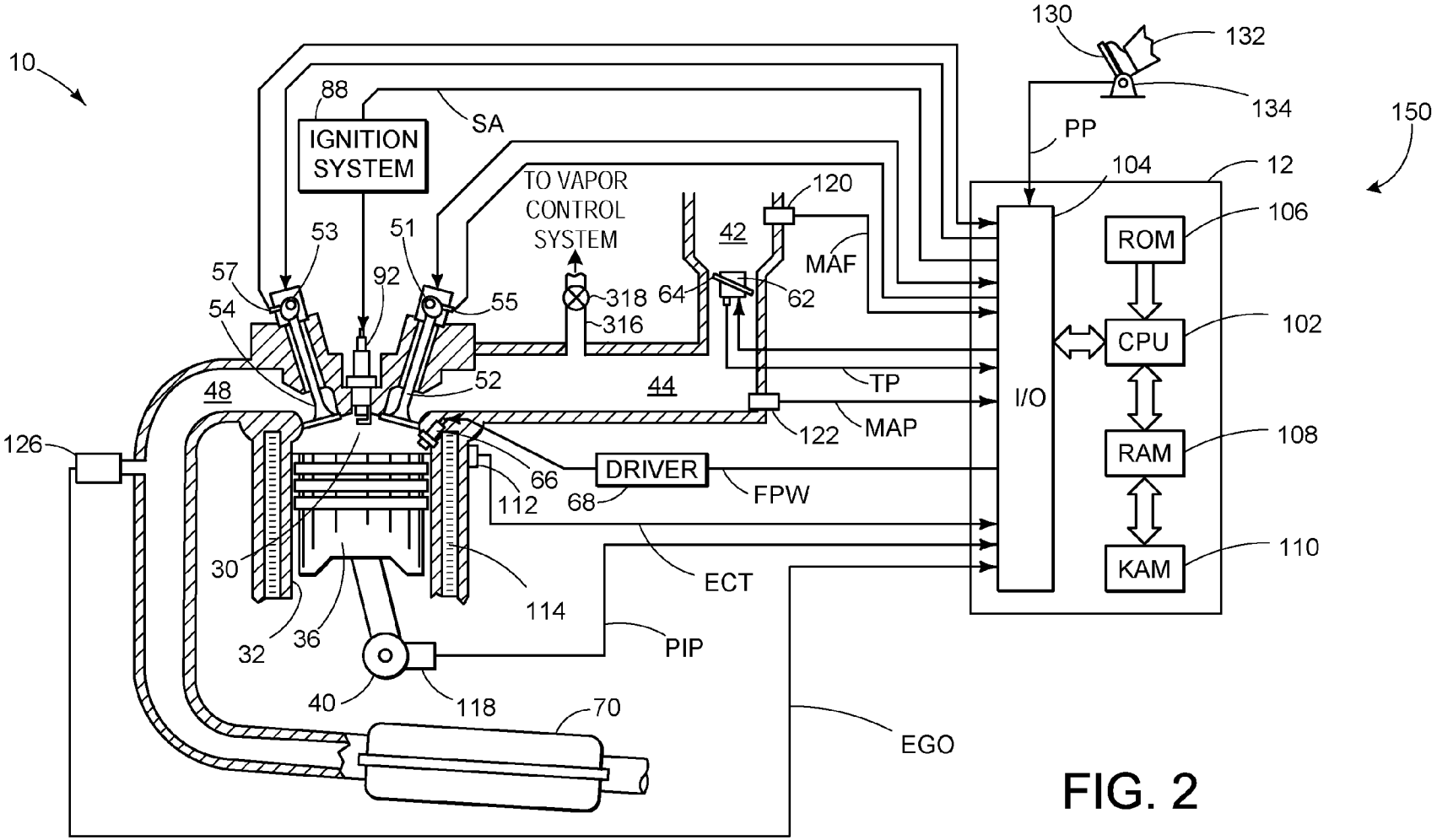
FIG. 2 illustrates a schematic depiction of an internal combustion engine which may be included in the vehicle shown in FIG. 1.
Figure 4:
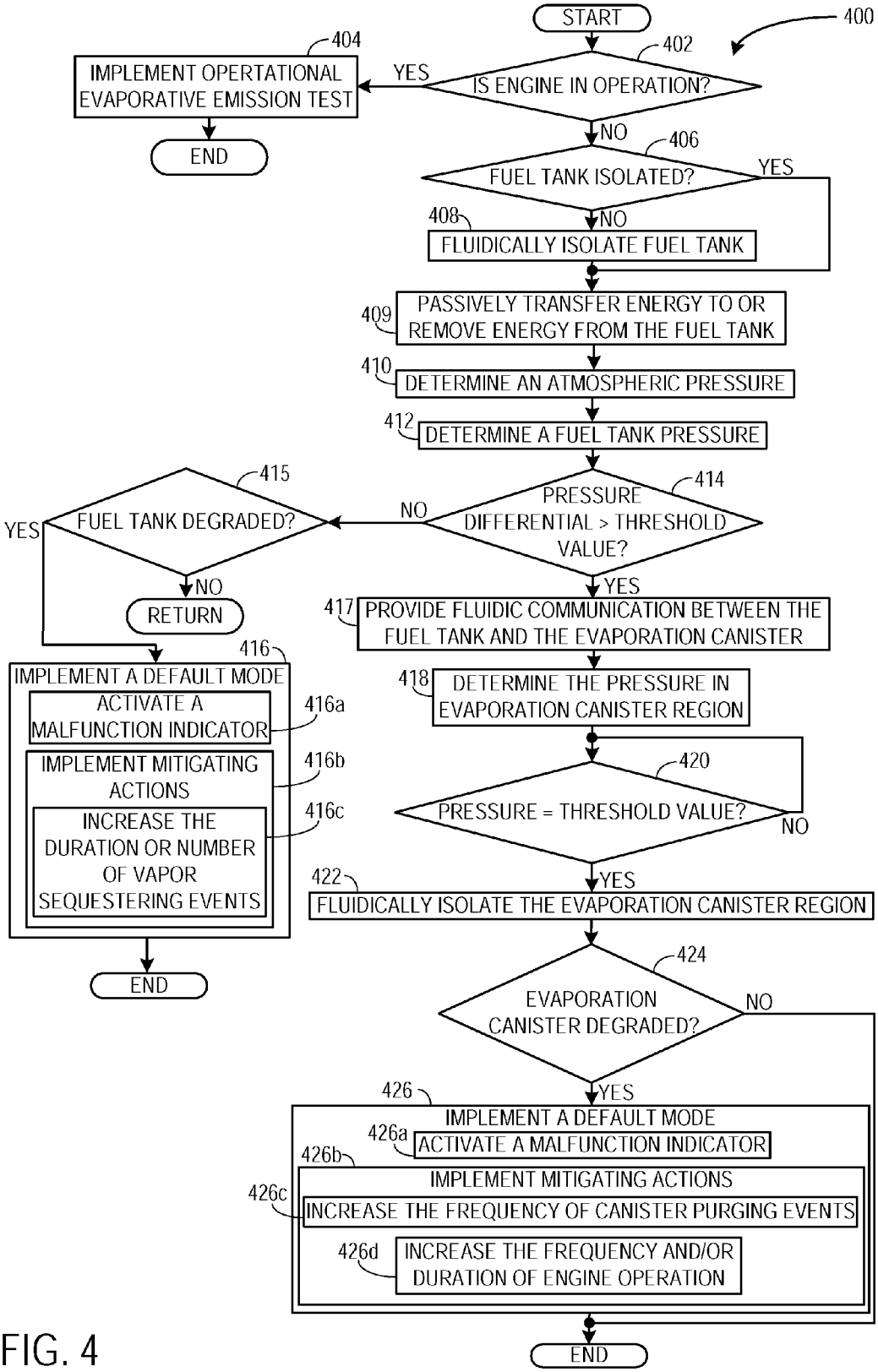
FIG. 4 illustrates a diagnostic method which may be implemented in a vehicle to determine the integrity of an evaporation canister.

FIG. 1 illustrates a schematic depiction of a vehicle with a hybrid propulsion system, while FIG. 2 illustrates a schematic depiction of an internal combustion engine which may be included in the hybrid propulsion system. FIG. 3 illustrates a schematic depiction of a fuel vapor control system which may be used in the vehicle illustrated in FIG. 1 and FIG. 4 shows a method for operation of the fuel vapor control system. In one example, a method for operating a fuel vapor control system included in a vehicle having an internal combustion engine is provided. The method may include storing positive pressure or negative pressure in an isolated fuel tank, transferring at least a portion of the positive pressure or the negative pressure to an evaporation canister region, and determining degradation of the evaporation canister based on a pressure response of the evaporation canister region while the evaporation canister region is isolated from the fuel tank.

In this way, the fuel vapor control system may be passively tested while the internal combustion is not in operation, increasing the duration over which the fuel vapor control system diagnostic test can be implemented, allowing the vehicle to determine when the fuel vapor control system has been compromised and take mitigating actions. Furthermore, the cost and complexity of the vehicle may be decreased, when compared to previous system utilizing mechanical components to drawn down the pressure within the vapor controls system to perform a diagnostic test on the fuel vapor control system, thereby increasing the vehicle's efficiency as well as reliability, while decreasing the vehicle's cost.

Referring to FIG. 1, the figure schematically depicts a vehicle 1 with a hybrid propulsion system 2. Hybrid propulsion system 2 includes an internal combustion engine 10, further described herein with particular reference to FIG. 2, coupled to transmission 3. Transmission 3 may be a manual transmission, automatic transmission, or combinations thereof. Further, various additional components may be included, such as a torque converter, and/or other gears such as a final drive unit, etc. Transmission 3 is shown coupled to drive wheel 4, which in turn is in contact with road surface 5. It will be appreciated that the transmission may be coupled to a plurality of drive wheels, in other examples.

In this example embodiment, the hybrid propulsion system 2 also includes an energy conversion device 6, which may include a motor, a generator, among others and combinations thereof. The energy conversion device 6 is further shown coupled to an energy storage device 7, which may include a battery, a capacitor, a flywheel, a pressure vessel, etc. The energy conversion device can be operated to absorb energy from vehicle motion and/or the engine and convert the absorbed energy to an energy form suitable for storage by the energy storage device (i.e. provide a generator operation). The energy conversion device can also be operated to supply an output (power, work, torque, speed, etc.) to the drive wheel 4 and/or engine 10 (i.e. provide a motor operation).

Additionally, the energy storage device 7 may be coupled to an external energy storage device 8 allowing the energy storage device to be charged while the vehicle is not in operation. For example, a user may plug in the vehicle to provide energy to the energy storage device. The suitable external energy sources include a 120 VA/C 60 Hz wall outlet, 220 VA/c 60 Hz outlet, a portable battery, etc. The energy conversion device can also be operated to supply an output (power, work, torque, speed, etc.) to the drive wheel 4 and/or engine 10 (i.e. provide a motor operation). It should be appreciated that the energy conversion device may, in some embodiments, include only a motor, only a generator, or both a motor and generator, among various other components used for providing the appropriate conversion of energy between the energy storage device and the vehicle drive wheels and/or engine.

The depicted connections between engine 10, energy conversion device 6, transmission 3, and drive wheel 4 indicates transmission of mechanical energy from one component to another, whereas the connections between the energy conversion device and the energy storage device may indicate transmission of a variety of energy forms such as electrical, mechanical, etc. For example, torque may be transmitted from engine 10 to drive the vehicle's drive wheel 4 via transmission 3. As described above energy storage device 7 may be configured to operate in a generator mode and/or a motor mode. In a generator mode, hybrid propulsion system 2 absorbs some or all of the output from engine 10 and/or transmission 3, which reduces the amount of drive output delivered to drive wheel 4, or the amount of braking torque to the drive wheel. Such operation may be employed, for example, to achieve efficiency gains through regenerative braking, improved engine efficiency, etc. Further, the output received by energy conversion device 6 may be used to charge energy storage device 7.

In the motor mode, energy conversion device 6 may supply mechanical output to engine 10 and/or transmission 3, for example by using electrical energy stored in the energy storage device (e.g. an electric battery). In this way, motive power may be provided the vehicle via the energy conversion device. In some examples, the motor mode may be implemented while the internal combustion engine is not in operation (e.g. performing combustion cycles). Additionally, in some examples, the motor mode may be implemented while the speed of the vehicle is a below a threshold speed and/or below a threshold torque or torque request. Thus, engine 10 may not be operated for an extended duration of time. Additionally or alternatively, the motor mode may be implemented during braking, while stopped at traffic lights, etc.

Assist or mild hybrid modes may also be employed, in which the engine is the primary torque source, with the hybrid propulsion system acting to selectively deliver added torque, for example during tip-in or other conditions. Further still, starter/generator and/or smart alternator systems may also be used. The various components described above with reference to FIG. 1 may be controlled by a vehicle controller as will be describe below with reference to FIG. 2.

In some embodiments, controller 12 can be configured to control operation of the various systems described above with reference to FIG. 2. For example, the energy storage device may be configured with a sensor that communicates with controller 12, thereby enabling a determination to be made of the state of charge or quantity of energy stored by the energy storage device. In another example, controller 12 or other controller can be used to vary a condition of the energy conversion device and/or transmission. Further, in some embodiments, controller 12 may be configured to cause combustion chamber 30 to operate in various combustion modes, as described herein. The fuel injection timing may be varied to provide different combustion modes, along with other parameters, such as valve timing, valve operation, valve deactivation, etc.

Referring now to FIG. 2, a schematic diagram showing one cylinder of multi-cylinder engine 10 is described, where the engine may be included in a propulsion system of an automobile as shown in FIG. 2. Engine 10 may be controlled at least partially by a control system 150 including controller 12 and by input from a vehicle operator 132 via an input device 130. In this example, input device 130 includes an accelerator pedal and a pedal position sensor 134 for generating a proportional pedal position signal PP. Combustion chamber (i.e. cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. A purge conduit 316 including a purge valve 318 disposed within may be coupled to the intake manifold. The purge conduit may be included in a fuel vapor control system discussed in greater detail herein with regard to FIG. 3. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. In this example VCT is utilized. However, in other examples, alternate valve actuation systems may be used, such as electronic valve actuation (EVA) may be utilized. The position of intake valve 52 and exhaust valve 54 may be determined by position sensors 55 and 57, respectively.

Fuel injector 66 is shown arranged in the combustion chamber 30 in a configuration that provides what is known as direct injection of fuel into the combustion chamber. Fuel injector 66 may inject fuel in proportion to the pulse width of signal FPW received from controller 12 via electronic driver 68. Fuel may be delivered to fuel injector 66 via a fuel delivery system, including a fuel tank 302 and a fuel pump 304, schematically illustrated in FIG. 3. It will be appreciated that additional components may be included in the fuel delivery system such as a fuel rail coupled to the fuel injector, a high pressure fuel pump, a fuel filter, etc. In some embodiments, combustion chamber 30 may alternatively or additionally include a fuel injector coupled to intake manifold 44 for injecting fuel directly therein, in a manner known as port injection.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof. In some embodiments, during operation of engine 10, emission control device 70 may be periodically reset by operating at least one cylinder of the engine within a particular air/fuel ratio.

Controller 12 is shown in FIG. 2 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft. Controller 12 may also be coupled to a plurality of pressure sensors discussed in more detail herein with regard to FIG. 3.

As described above, FIG. 2 shows only one cylinder of a multi-cylinder engine, and that each cylinder may similarly include its own set of intake/exhaust valves, fuel injector, spark plug, etc.

FIG. 3 illustrates a fuel vapor control system 300. Fuel vapor control system 300 may include a fuel tank 302 configured to store various types of fuel such as diesel, gasoline, ethanol blends, bio-diesel, etc. The fuel tank may include a fuel pump 304 (e.g. lift pump), which may be electrically driven in some examples. The fuel pump may be fluidly coupled to fuel injector 66, as discussed above. Furthermore, in other examples the fuel delivery system may further include one or more of a mechanically driven high pressure pump, a fuel filter, a return-less fuel circuit, etc.

Returning to FIG. 3, an evaporation conduit 306 may fluidly coupled fuel tank 302 to an evaporation canister 308. A fuel tank isolation valve 310 may be disposed in the evaporation conduit 306. The evaporation canister may include activated carbon, which may sequester at least a portion of the evaporative emissions from the fuel tank during various operating conditions, such as during refilling of the fuel tank. The canister may further include alternative materials, such as zeolite. An atmospheric conduit 312 including a vent valve 314 disposed within may be coupled to evaporation canister 308 and the surrounding atmosphere.

Evaporation canister 308 may also be fluidly coupled to intake manifold 44 included in engine 10, illustrated in FIG. 2, via a purge conduit 316. However, in other examples the purge conduit may be coupled in another suitable location within the engine. A purge valve 318 may be disposed in purge conduit 316.

In some examples, the aforementioned valves (310, 314, and 318) may be vacuum operated solenoid valves. However, other suitable valves may be used, in other examples. The valves may be coupled to controller 12, shown in FIG. 2, which may be configured to adjust the valves. Moreover, the valves (310, 314, and 318) may be included in control system 150. However, in other examples another controller may be used to adjust the valves. Furthermore the valves may be configured to operate in at least two positions, an open position and closed position, in some examples. However, in other examples the valves may operate in a plurality of positions which correspond to various degrees of obstruction of the conduit. It will be appreciated that an open valve may include a valve in which fluid can pass through the valve. Therefore, an open valve may include a valve which is partially obstructing flow through the conduit or a conduit which is substantially unobstructed. An evaporation canister region 320 may include a fluidically isolated region surrounding evaporation canister 308 as well as the evaporation canister itself. The evaporation canister region may include the evaporation canister as well as the portions of conduit between the valves (310, 314, and 318) and the evaporation canister.

A number of pressure sensors may be included in fuel vapor control system 300, such as a fuel tank pressure sensor 322 coupled to the fuel tank, a pressure sensor 324 coupled to evaporation conduit 306, and an atmospheric pressure sensor 326 coupled to the atmospheric conduit 312. The pressure sensors may be capacitive pressure sensors or other suitable types of pressure sensors. The fuel tank pressure sensor may be configured to measure the pressure within the fuel tank. Likewise, pressure sensor 324 may be configured to measure the pressure in the evaporation canister region 320 and the atmospheric pressure sensor may be configured to measure the atmospheric pressure. The pressure sensors described above may be electronically coupled to controller 12, shown in FIG. 2.

The fuel vapor control system may operate in various modes, implemented via controller 12, shown in FIG. 2. However, in other examples other suitable controllers may be utilized to implement the modes of the fuel vapor control system. The modes may include a vapor sequestering mode, a purge mode, and a passive diagnostic mode.

In the vapor sequestering mode fuel vapor may be directed into the evaporation canister from the fuel tank. The vapor sequestering mode may be implemented while the fuel tank is being refueled as well as other operating conditions. Thus in some examples, fuel vapor control system 300 may be configured such that the vent valve 314 and fuel tank isolation valve 310 are open and purge valve 318 is closed, in the vapor sequestering mode. In this way, fuel vapors from the fuel tank may be directed to the evaporation canister and sequestered.

In the purge mode fuel vapor from the evaporation canister may be directed to the engine (e.g. intake manifold). The purge mode may be implemented while the engine is in operation and carrying out combustion in at least one cylinder. In some examples, fuel vapor control system 300 may be configured such that the fuel tank isolation valve is closed and the purge valve and the vent valve are open, during the purge mode. In this way, fuel vapor is drawn into (or pushed into) the intake manifold, reducing the amount of fuel vapor stored in the evaporation canister. It will be appreciated that the purge mode may be implemented intermittently during operation of the internal combustion engine.

The passive diagnostic mode may include a mode in which positive pressure or negative pressure is generated in the fuel tank via diurnal ambient temperature fluctuations, to test the integrity of evaporation canister 308. The passive diagnostic mode may be carried out via implementation of diagnostic method 400, described below, for example when the engine is shut-down, for example when the engine is non-rotating and non-combusting.

FIG. 4 shows a diagnostic method 400 which may be implemented to determine if the evaporation canister or fuel vapor control system has been degraded (e.g. if leaks are present). Method 400 may be implemented by the systems and components described above, in some examples. However, in other examples, method 400 may be implemented via other suitable systems and components. Method 400 may be implemented while the internal combustion engine is or is not in operation (e.g. shut down). In this way, a diagnostic test may be performed on the fuel vapor control system during periods of vehicle operation while the internal combustion engine is shut down. Thus, the number of diagnostic test may be increased in vehicles which utilize multiple sources of motive power.

At 402 it is determined if the internal combustion engine is in operation. Operation of the internal combustion engine may include operating various components in the engine to perform combustion cycles. It will be appreciated that in other examples the actions of 402 may not be included in method 400. If the internal combustion engine is in operation (YES at 402) the method proceeds to 404 where an operational evaporative emission test is implemented. An operational evaporative emission test may include a test in which the pressure in the evaporation canister is drawn down via operation of the internal combustion engine. However, it will be appreciated that alternate suitable tests may be utilized, in other examples. Thus, diagnostic testing of the fuel system may be carried out during engine operation, if desired, for example, by applying engine generated manifold vacuum to the fuel tank, and then isolating one or more components and then monitoring pressure. After 404 the method ends.

However, if the internal combustion engine is not in operation (NO at 402) the method proceeds to 406. In some examples, the engine is not in operation when a shut-down mode is implemented, the shut-down mode including a time interval in which combustion cycles are not performed in the internal combustion engine and rotational energy is not provided to the crankshaft via the internal combustion engine, or alternatively if the engine is at rest. The shut-down mode may be maintained until 422, in some examples. Additionally, an energy conversion device may provide motive power to the vehicle at least until 422, in some examples. At 406 it is determined if the fuel tank is isolated from the surrounding atmosphere and external components, such as the evaporation canister, other components in the fuel vapor control system, the engine, etc. Fluidic isolation may include an operating state in which fluidic communication between the fuel tank and other components as well as the surrounding atmosphere is substantially inhibited, which state may be generated via the control system. For example, when a fuel vapor control system includes a fuel tank isolation valve, the fuel tank isolation valve may be closed to fluidically isolate the fuel tank from the surrounding atmosphere and external components. However, it will be appreciated that the fuel vapor control system may have an alternate configuration in which additional or alternate valves may be closed to fluidically isolate the fuel tank.

If the fuel tank is not fluidically isolated (NO at 406) the method proceeds to 408 where the fuel tank is fluidically isolated from the surrounding atmosphere and external components. In some examples, fluidic isolation of the fuel tank may include closing the fuel tank isolation valve, depicted in FIG. 3. Diurnal temperature fluctuations may then generate a positive pressure or a negative pressure within the fuel tank. Therefore, in some examples the method may include at 409, passively transferring energy to or removing energy from the fuel tank via an external temperature fluctuation. For example, the pressure within the fuel tank may be changed without applying pressure or vacuum generated by another component of the vehicle (e.g., the engine, a vacuum pump, etc.), increasing the efficiency of the diagnostic method. On the other hand, if the fuel tank is fluidically isolated (YES at 406) the method proceeds to 409.

At 410, the atmospheric pressure may be determined. Next, at 412, the fuel tank pressure is determined. The method then proceeds to 414, where it is determined if the pressure differential between the fuel tank and the atmospheric pressure exceeds a threshold value. It will be appreciated that the pressure differential may include a positive pressure as well as a negative pressure. Therefore, in some examples, an absolute value of the pressure differential may be determined. Various parameters may be taken into account when determining the threshold value such as the valve tolerances, precision of the pressure sensors, the engine temperature, and/or the ambient temperature.

If the pressure differential does not exceed the threshold value (NO at 414), the method proceeds to 415 where it is determine if the fuel tank has been degraded based on a pressure response of the fuel tank. A degraded fuel tank may include an evaporation canister which is experiencing leaks due to the corrosion, deterioration, etc., of the fuel tank housing, the valves coupled to the fuel tank, and/or the portions of the conduits coupling the fuel tank to the valves. Therefore, the pressure within a degraded fuel tank may be decaying towards the atmospheric pressure. Moreover, the monitored pressure response of the fuel tank may include a time rate of change of the pressure within the fuel tank, a pressure differential determined over a time interval within the fuel tank, and/or a pressure response curve (e.g. a plurality of pressure measurements taken at successive time intervals). In some examples, degradation of the evaporation canister may be determined via comparison of the pressure response of the fuel tank to a reference pressure response, which may be predetermined. The reference pressure response may be calculated based on a pressure response of a fuel tank which has not been degraded. The reference pressure response may be determined utilizing the following parameters: valve tolerances, atmospheric pressure, ambient temperature, fuel composition, and/or engine temperature.

Specifically, in one example, if a pressure response curve deviates from the reference pressure response curve by a threshold value it may be determined that the fuel tank has been degraded. However, in other examples if the absolute value of the time rate of change of the pressure in the fuel tank exceeds a threshold value, it is determined that the fuel tank has been degraded. Still further in other examples, a pressure differential within the fuel tank may be compared to a reference pressure differential, if the difference between the pressure differentials exceeds a threshold value it is determined that the fuel tank has been degraded.

If it is determined that the fuel tank has not been degraded (NO at 415) the method returns to the start. However, if it is determined that the fuel tank has been degraded (YES at 415) the method advances to 416 wherein a fuel tank default mode is implemented. The fuel tank fault mode may include at 416*a*, activating a fuel tank malfunction indicator on an instrument panel and at 416*b*, implementing mitigating actions which may include at 416*c*, increase the number or duration of vapor sequestering events. A vapor sequestering event may include a time interval during which the vapor sequestering mode is being performed. Further in some examples, the mitigating actions may also include decreasing the operational duration of the internal combustion engine or inhibiting operation of the internal combustion engine. After 416 the method ends.

On the other hand, if the pressure differential exceeds the threshold value (YES at 414) the method advances to 417 where fluidic communication is provided between the fuel tank and the evaporation canister. In this way, positive pressure or negative pressure may be transferred from the fuel tank to the evaporation canister. In some examples, providing fluidic communication between the fuel tank and the evaporation canister may include closing the canister vent valve, closing the canister purge valve, and opening the fuel tank isolation valve. Further, in some example, the fluidic communication is provided between the fuel tank and the evaporation canister, while isolating one or both of these from atmosphere and/or other components such as the engine. However, it will be appreciated that in other examples, the fuel vapor control system may have an alternate configuration. Therefore, alternate or additional valve may be closed to provide fluidic communication between the fuel tank and the evaporation canister.

The pressure in evaporation canister region may be determined, at 418. The evaporation canister region may include the evaporation canister as well as the sections of conduit between the various valves coupled to the evaporation canister and the evaporation canister. However, in other examples, the pressure in the fuel tank or the time rate of change of the pressure in the fuel tank and/or the evaporation canister may be determined. Next at 420 it is determined if the pressure in the evaporation canister region has reached a threshold value. The threshold value may be determined based on the positive or negative pressure generated within the fuel tank, valve tolerances, the ambient temperature, the engine temperature, etc. It will be appreciated that in other embodiments it may be determined if the pressure in the fuel tank has reached a threshold value, if the time rate of change of the pressure in the evaporation canister region or fuel tank has reached a threshold value, or if the pressure in the evaporation canister is substantially equivalent to the pressure in the fuel tank. If the pressure has not reached a threshold value the method returns to 420. However, if the pressure had reached a threshold value the method advances to 422 where an evaporation canister region is fludically isolated from the surrounding atmosphere and external components, such as the fuel tank and the engine. Isolation of the evaporation canister region may include closing the vent valve, the fuel tank isolation valve, and the purge valve, in some examples. However, it will be appreciated that in other examples, the fuel vapor control system may have an alternate configuration. Therefore, alternate or additional valves may be closed to isolate the evaporation canister region.

Next at 424 it is determined if the evaporation canister has been degraded based on a pressure response of the evaporation canister region. Degradation of the evaporation canister may be determined in a similar manner to the way in which degradation of the fuel tank was determined, as described above. For example, the pressure response of the evaporation canister may be compared to a reference pressure response of the evaporation canister, the reference pressure response calculated based on the pressure response of an evaporation canister which has not been degraded. Further, it should be appreciated that different expected pressure response rates of change may be applied depending on whether positive or negative pressure is transferred to the canister. For example, positive pressure may decay faster than a negative pressure may rise to atmospheric. If the pressure response of the evaporation canister is deviates from the reference pressure response by a threshold value, the evaporation canister is degraded.

If it is determined that the evaporation canister is not degraded (NO at 424) the method ends. However, if it is determined that the evaporation canister has been degraded (YES at 424) the method advances to 426 where an evaporation canister default mode is implemented. In some examples, the default mode may include at 426*a*, activating an evaporation canister malfunction indicator on an instrument panel and at 426*b*, implementing mitigating actions, which may include at 426*c*, increasing the frequency of canister purging events, and at 416*d* increasing the duration and/or frequency of engine operation. In this way, the evaporative emission may be reduced. However, it will be appreciated that additional or alternate elements may be included in the default mode such as other mitigating actions. After 426 the method ends.

The systems and methods described above allow pressure which may be passively generated in the fuel tank, even during shut-down engine operation and during vehicle operation, to be used verify the integrity of the evaporation canister. Moreover, it is possible to verify the integrity of both the fuel tank as well as the evaporation canister. Thus, it can be possible to more completely test the system, as well as increase the number of evaporation canister testing events. Therefore, degradation of various components within the fuel vapor control system may be quickly diagnosed and subsequently mitigated, decreasing vehicle emissions.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating a fuel vapor control system-in a vehicle having an engine, comprising:

storing positive or negative pressure in a fuel tank while isolated from an evaporation canister region;

transferring at least a portion of the stored pressure to the canister region; and indicating degradation of the evaporation canister region based on a response of the transferred pressure in the canister region while the canister region is isolated from the fuel tank.

2. The method of claim 1, wherein transferring at least a portion of the positive pressure or the negative pressure to the evaporation canister region includes providing fluidic communication between the fuel tank and the evaporation canister region.

3. The method of claim 2, wherein the fluidic communication is provided in response to a time rate of change of the pressure in the fuel tank or evaporation canister region reaching a threshold value.

4. The method of claim 1, further comprising, preceding storing positive pressure or negative pressure in an isolated fuel tank, generating a positive pressure or a negative pressure in the fuel tank via ambient temperature fluctuations.

5. The method of claim 1, wherein storing positive or negative pressure and transferring at least a portion of the stored pressure are implemented while the vehicle operates in a mode in which motive power is provided to the vehicle via an energy conversion device.

6. The method of claim 1, further comprising, subsequent to determining degradation of the evaporation canister region, implementing a default action in response to the degradation determination, the default action including at least one of activating a malfunction indicator on an instrument panel and implementing mitigating actions.

7. The method of claim 6, wherein the mitigating actions include increasing a frequency of canister purging events and/or increasing frequency and/or duration of engine operation.

8. A method for operating a fuel vapor control system included in a vehicle having an internal combustion engine, the method comprising:

fluidically isolating a fuel tank from the atmosphere and external components;

if a pressure differential between a fuel tank pressure and an atmospheric pressure is greater than a first threshold value, providing fluidic communication between an evaporation canister region and the fuel tank;

fluidically isolating the evaporation canister region from the atmosphere and external components after providing the fluidic communication; and if a time rate of change of a pressure within the isolated evaporation canister region exceeds a second threshold value, implementing an evaporation canister default mode; and maintaining the internal combustion engine in a shut-down mode and providing motive power to the vehicle via an energy conversion device while fluidically isolating the fuel tank and while providing fluidic communication between the evaporation canister region and the fuel tank.

9. The method of claim 8, wherein the pressure differential between the fuel tank and the atmospheric pressure is generated via external temperature fluctuations.

10. The method of claim 8, wherein fluidic isolation of the evaporation canister region is implemented in response to the pressure in the evaporation canister region reaching a threshold value.

11. The method of claim 8, further comprising subsequent to fluidically isolating the fuel tank when the pressure differential between the fuel tank pressure and the atmospheric pressure is not greater than a third threshold value, if a time rate of change of a pressure within the isolated fuel tank exceeds a fourth threshold value, implementing a fuel tank default mode.

12. The method of claim 8, wherein implementing the evaporation canister default mode includes at least one of activating a malfunction indicator and implementing mitigating actions.

13. The method of claim 8, wherein the pressure differential includes an absolute value of both positive and negative pressures.

14. A fuel vapor control system for a vehicle including an internal combustion engine, the system comprising:

an atmospheric pressure sensor electronically coupled to a controller;

a fuel tank including a fuel tank pressure sensor electronically coupled to the controller;

an evaporation canister fluidly coupled to the fuel tank, the internal combustion engine, and a surrounding atmosphere;

a pressure sensor coupled within an evaporation canister region and electronically coupled to the controller;

a control system including the controller having code executable via a processor to:

fluidically isolate the fuel tank from the surrounding atmosphere and external components;

provide fluidic communication between the fuel tank and the evaporation canister region when a pressure differential between the fuel tank and the surrounding atmosphere exceeds a first threshold value after the fuel tank is fluidically isolated;

fluidically isolate the evaporation canister region from the surrounding atmosphere and external components after fluidic communication is provided between the fuel tank and the evaporation canister region; and implement a default mode when a time rate of change of a pressure exceeds a second threshold value and/or a pressure differential within the evaporation canister region exceeds a third threshold value.

15. The system of claim 14, wherein the evaporation canister region is fluidically isolated after an evaporation canister pressure has reached a fourth threshold value.

16. The system of claim 14, further comprising an energy conversion device, wherein the internal combustion engine is maintained in a shut-down mode and motive power is provided to the energy conversion device while the fuel tank is fluidically isolated and fluidic communication is provided between the fuel tank and the evaporation canister region.

17. The system of claim 14, further comprising a fuel tank isolation valve fluidly coupled to the fuel tank and the evaporation canister, wherein fluidically isolating the fuel tank includes closing the fuel tank isolation valve.

18. The system of claim 17, further comprising a canister vent valve fluidly coupled to the evaporation canister and the atmosphere and a canister purge valve fluidly coupled to the evaporation canister and the engine, wherein allowing fluidic communication between the fuel tank and the evaporation canister region includes opening the fuel tank isolation valve and fluidically isolating the evaporation canister region includes closing the canister vent valve and the canister purge valve.

* * * * *